US005876219A

United States Patent [19]

Taylor et al.

[11] Patent Number: 5,876,219

[45] Date of Patent: Mar. 2, 1999

[54] BOARD-TO-BOARD CONNECTOR ASSEMBLY

[75] Inventors: Attalee S. Taylor, Palmyra; Adam D. Cunningham, Middletown; Melissa A. Sherman, Mechanicsburg, all of Pa.

[73] Assignee: The Whitaker Corp., Wilmington, Del.

[21] Appl. No.: 920,638

[22] Filed: Aug. 29, 1997

[51] Int. Cl.[6] ..... H01R 9/09

[52] U.S. Cl. ..... 439/74; 439/680

[58] Field of Search ..... 439/74, 83, 682, 439/680

[56] References Cited

U.S. PATENT DOCUMENTS

| | | | |
|---|---|---|---|
| 3,745,512 | 7/1973 | Johnson et al. | 439/599 |
| 4,284,311 | 8/1981 | Forster et al. | 439/34 |
| 4,682,833 | 7/1987 | Ferchau et al. | 439/377 |
| 4,917,614 | 4/1990 | Kikuchi et al. | 439/83 |
| 5,037,316 | 8/1991 | Fukushima et al. | 439/83 |
| 5,122,066 | 6/1992 | Plossmer | 439/78 |
| 5,306,168 | 4/1994 | Kunishi et al. | 439/248 |
| 5,410,258 | 4/1995 | Bowers et al. | 324/755 |
| 5,443,398 | 8/1995 | Ortega | 439/378 |
| 5,545,051 | 8/1996 | Summers et al. | 439/74 |
| 5,556,286 | 9/1996 | Ikesugi et al. | 439/74 |
| 5,591,941 | 1/1997 | Acocella et al. | 174/266 |
| 5,593,322 | 1/1997 | Swamy et al. | 439/660 |

*Primary Examiner*—Neil Abrams
*Assistant Examiner*—Barry M-L. Standig
*Attorney, Agent, or Firm*—Robert Kapalka

[57] ABSTRACT

An electrical connector assembly for interconnecting a pair of circuit boards in parallel spaced-apart planes comprises first and second connectors. The first connector includes a dielectric first housing having a mating face and an array of first contacts exposed along the mating face. The first housing has a shroud which defines a boundary around the array of first contacts. The shroud has an edge at a height above the mating face and the first contacts are recessed below the edge. The second connector includes a dielectric second housing having a mating face and an array of second contacts exposed along the mating face for mating with the first contacts. The second housing is configured for complementary reception within the boundary of the shroud, wherein the shroud serves to align the first and second housings for mating before engagement of the first and second contacts can occur.

9 Claims, 7 Drawing Sheets

BOARD-TO-BOARD CONNECTOR ASSEMBLY

FIELD OF THE INVENTION

The invention relates to an electrical connector assembly for mating parallel circuit boards.

BACKGROUND OF THE INVENTION

Microprocessors in computers are typically mounted on a motherboard either by direct attachment to the motherboard or by reception in a socket which is mounted on the motherboard. An evolving trend which is directed to enhancing computer capabilities is to mount the microprocessor on a separate processor board along with memory devices, and then mate the processor board to the mother board. Size considerations for laptop computers require that the processor board be mounted in a closely spaced-apart, parallel relationship with the mother board. Electrical connectors are known for interconnecting circuit boards in parallel, spaced-apart relationship. A problem with these connectors is that they have a relatively low number of input/output (I/O) terminals arranged in a dual row linear array. In order to accommodate the enhanced microprocessors having hundreds of I/O's, the known connectors would need to be excessively long. Therefore, it would be desirable to arrange the I/O's in a grid of multiple columns and rows. Currently there is no suitable connector which permits circuit board interconnections through a grid array. Further, due to the continuing trend toward miniaturization of computers and other electronic devices, connectors for electrically mating circuit boards are constantly being reduced in size. As the connectors become smaller, it becomes increasingly difficult to align the mating halves of an electrical connector assembly. There is a need for a connector assembly which provides alignment and mating features in a small size package.

SUMMARY OF THE INVENTION

An electrical connector assembly for interconnecting a pair of circuit boards in parallel spaced-apart planes comprises first and second connectors. The first connector includes a dielectric first housing having a mating face and an array of first contacts exposed along the mating face. The first housing has a shroud which defines a boundary around the array of first contacts. The shroud has an edge at a height above the mating face and the first contacts are recessed below the edge. The second connector includes a dielectric second housing having a mating face and an array of second contacts exposed along the mating face for mating with the first contacts. The second housing is configured for complementary reception within the boundary of the shroud, wherein the shroud serves to align the first and second housings for mating before engagement of the first and second contacts can occur.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
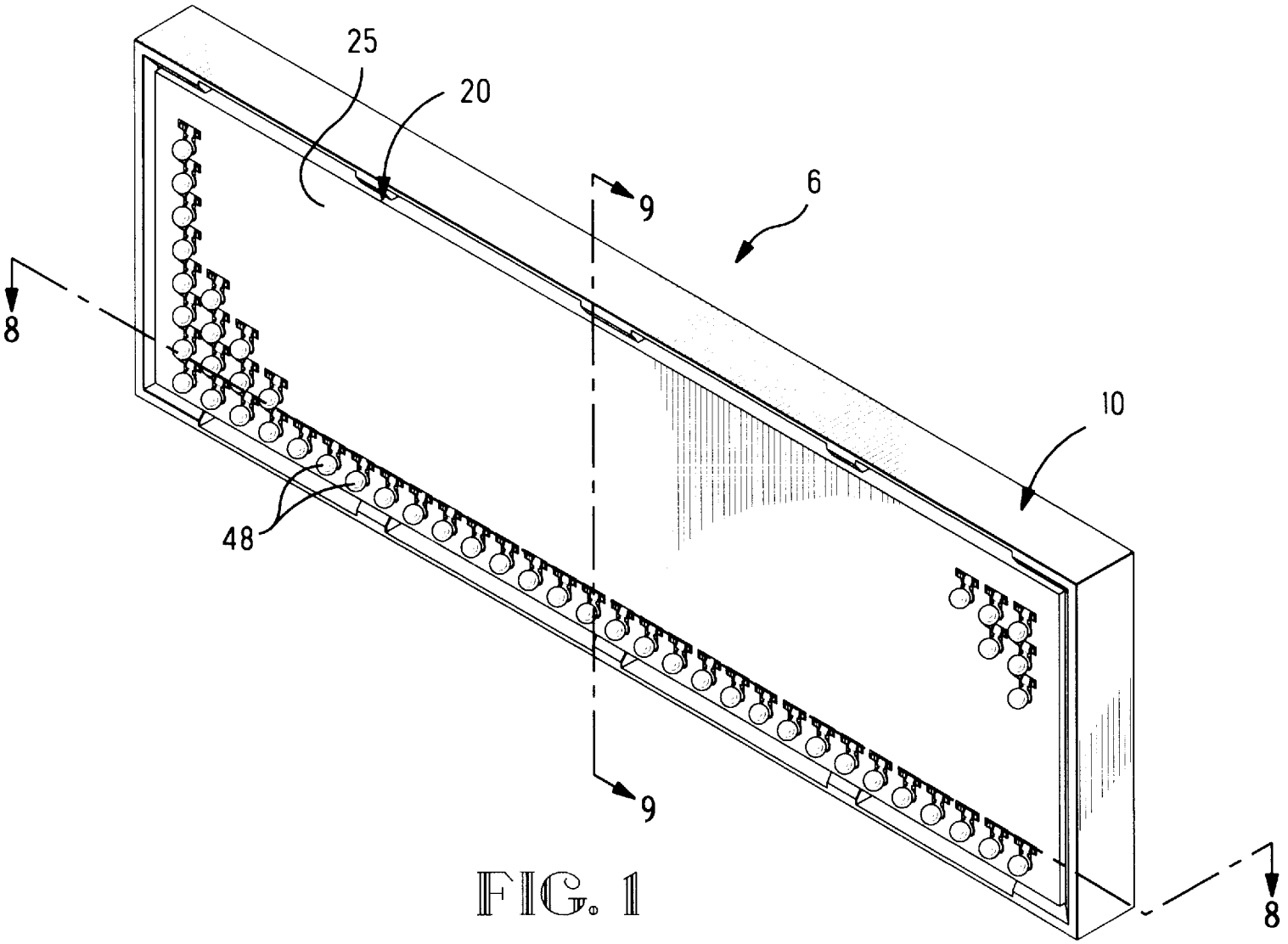
FIG. 1 is an isometric view of an electrical connector assembly according to the invention.
Figure 2:
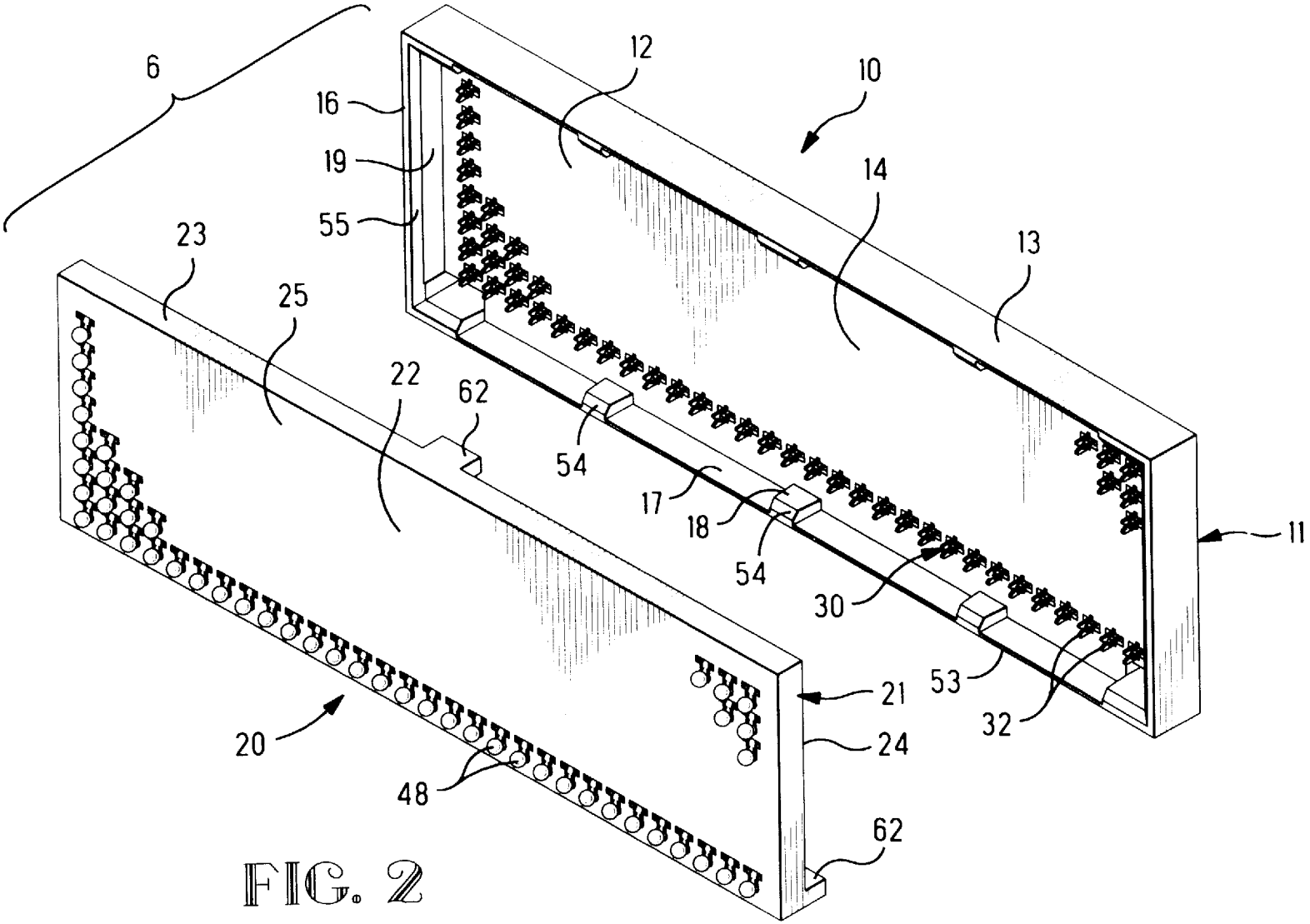
FIG. 2 is an isometric view of the connector assembly in unmated condition.
Figure 3:
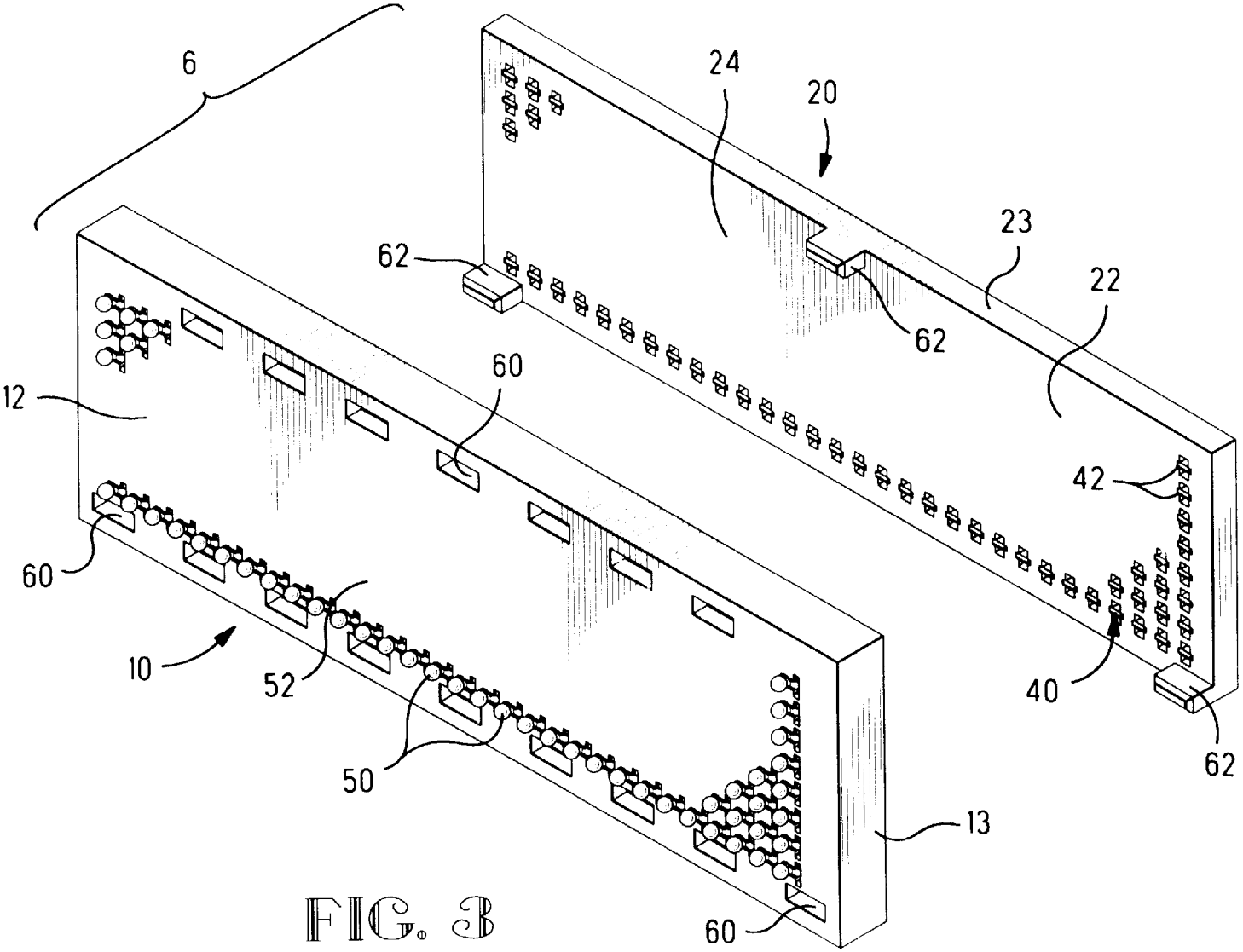
FIG. 3 is an isometric view of the unmated connector assembly from a different direction.

There is shown in FIGS. 1–3 an electrical connector assembly 6 comprising a first connector 10 and a second connector 20. The first connector has a board mounting face 52 and a plurality of solder balls 50 which extend beyond the board mounting face for attachment to circuit traces on a first circuit board (not shown). Similarly, the second connector has a board mounting face 25 and a plurality of solder balls 48 which extend beyond the board mounting face for attachment to traces on a second circuit board (not shown). When the first and second connectors are mated as shown in FIG. 1, an interconnection of very low height is obtained between parallel circuit boards.

Figure 4:
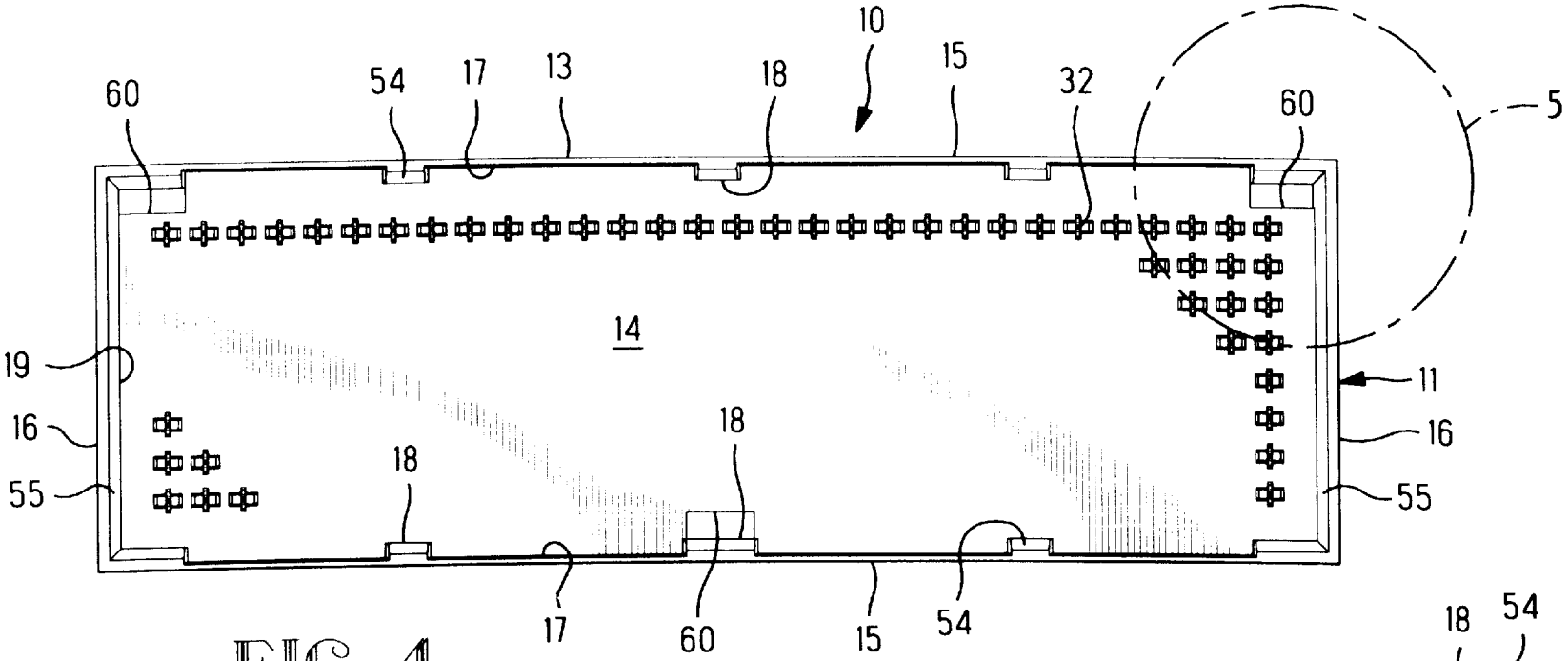
FIG. 4 is a plan view of a first connector for the assembly showing a mating face thereof.
Figure 5:
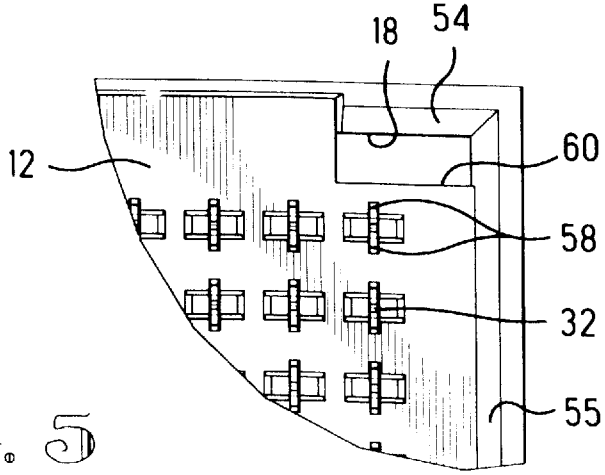
FIG. 5 is an enlarged view of a portion of FIG. 4.

With reference also to FIGS. 4 and 5, the first connector 10 includes a dielectric first housing 11 having a planar base portion 12 and an integral shroud 13. The base portion 12 holds a plurality of first contacts 30 which have mating portions 32 that are exposed in an array over a mating face 14 of the base portion 12. Although only a portion of the first contact array is shown for clarity, it should be understood that the first contact array preferably comprises full rows and columns of contacts in a rectangular grid.

The shroud 13 circumscribes a boundary around the array of first contact mating portions 32. The shroud 13 includes longitudinal walls 15 and lateral walls 16 which cooperate to define a receptacle for the second connector 20. The longitudinal walls 15 have portions of reduced thickness 17. Surfaces 18 along the longitudinal walls and surfaces 19 along the lateral walls define an inside wall of the receptacle. The shroud 13 extends to an edge 53 having a height above the base portion 12 which is sufficient so that the first contact mating portions 32 are recessed below the edge 53 of the shroud. The walls 15, 16 have chamfers 54, 55, respectively, adjacent to the edge 53 of the shroud. The base portion 12 has three holes 60 which receive polarizing and alignment pins of the second connector.

Figure 6:
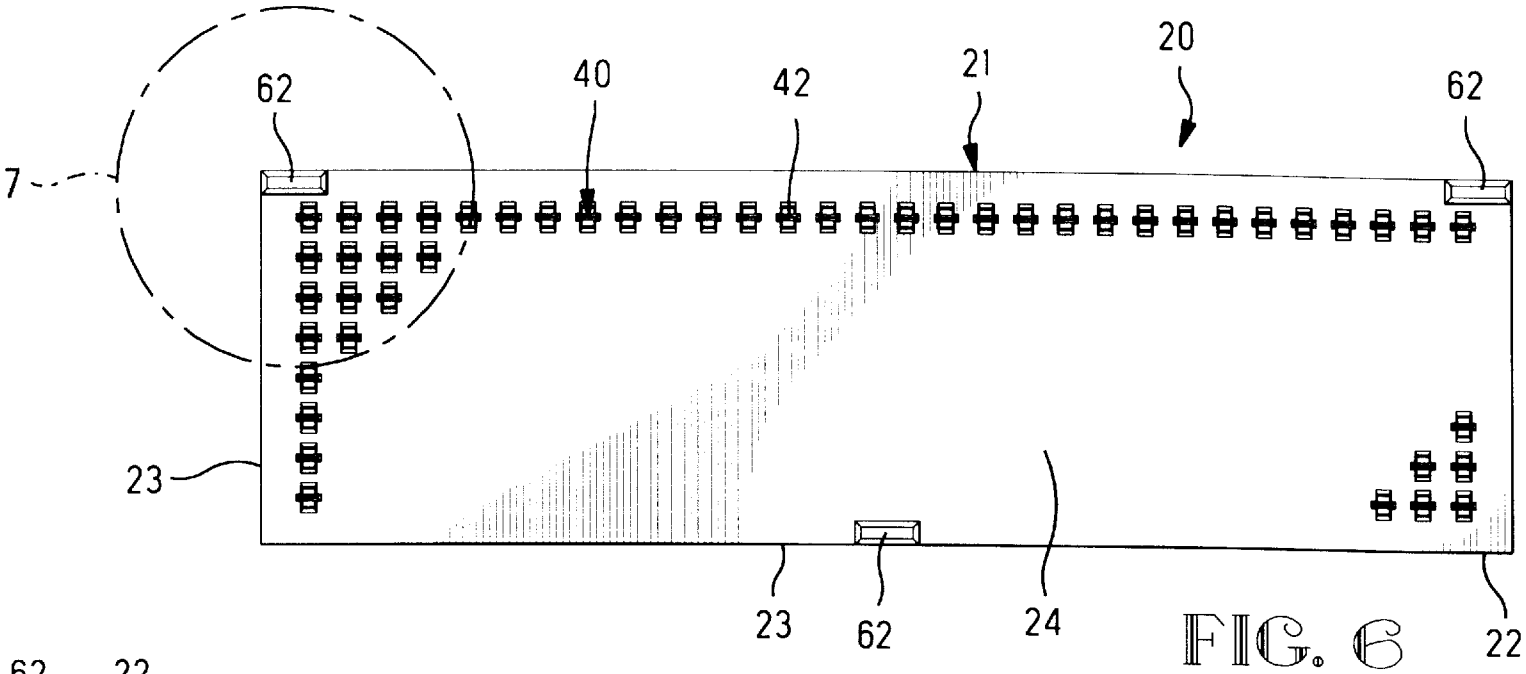
FIG. 6 is a plan view of a second connector for the assembly showing a mating face thereof.
Figure 7:
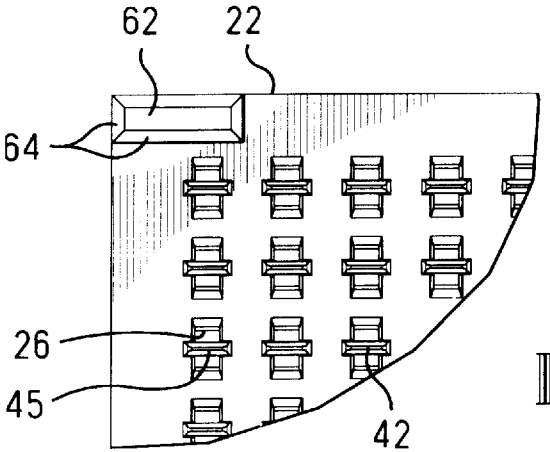
FIG. 7 is an enlarged view of a portion of FIG. 6.
Figure 8:
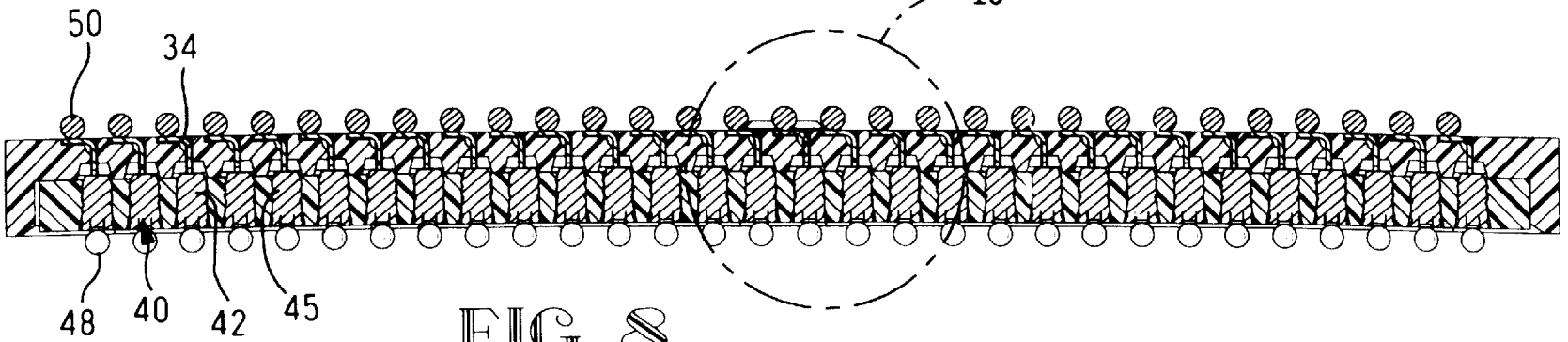
FIG. 8 is a cross-sectional view taken along line 8—8 of FIG. 1.
Figure 10:
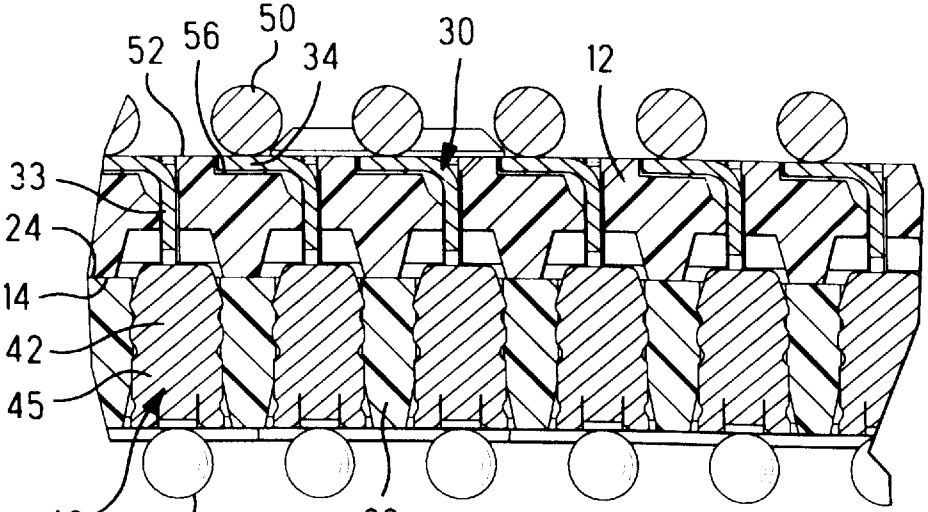
FIG. 10 is an enlarged view of a portion of FIG. 8.
Figure 9:
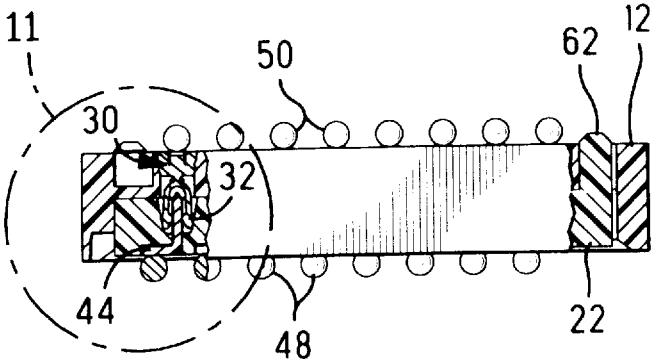
FIG. 9 is a cross-sectional view taken along line 9—9 of FIG. 1.
Figure 11:
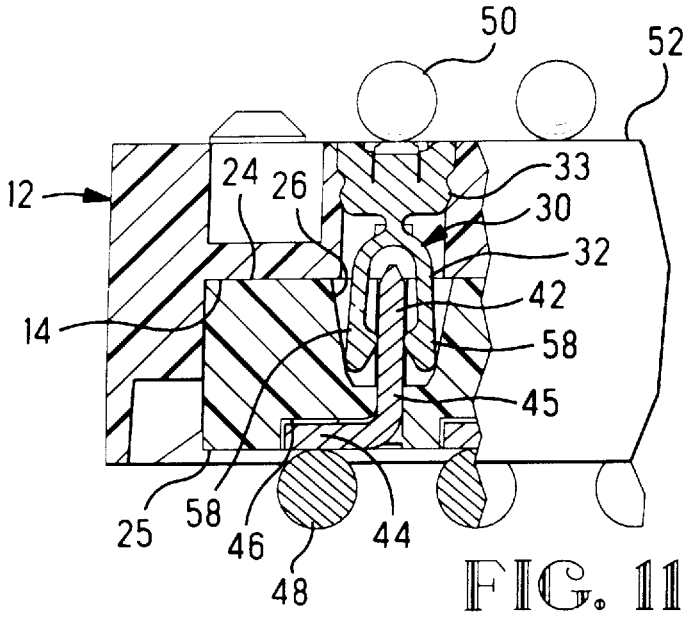
FIG. 11 is an enlarged view of a portion of FIG. 9.
Figure 12:
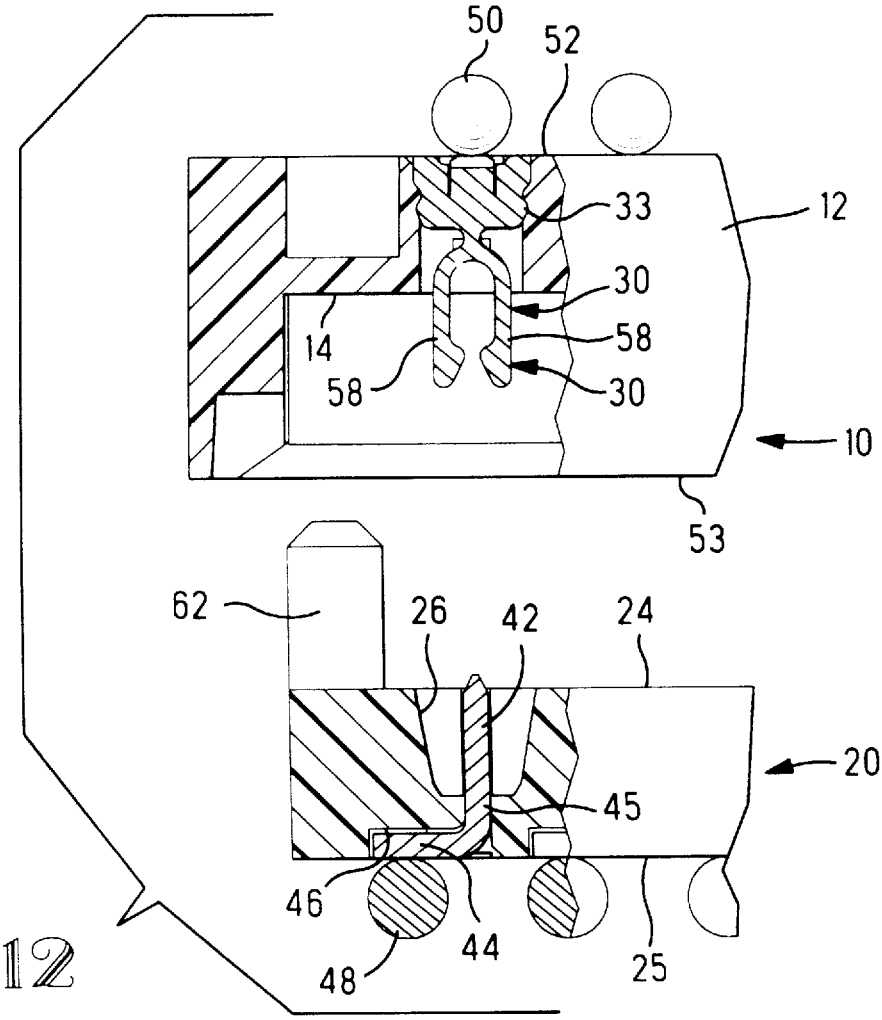
FIG. 12 is a view of the connectors of FIG. 11 in an unmated condition.

With reference also to FIGS. 6 and 7, the second connector 20 includes a dielectric second housing 21 which is configured as a flat plate member 22 having integral polarizing and alignment pins 62. The plate member 22 holds a plurality of second contacts 40 which having mating portions 42 that are exposed in an array over a mating face 24 of the second housing for mating with the first contact mating portions 32. The plate member 22 is configured for reception within the shroud 13. That is, the plate member 22 has a peripheral edge 23 which is dimensioned to be received within the inside wall surfaces 18, 19 of the receptacle that is defined by the shroud. Further, the plate member has a thickness between the mating face 24 and board mounting face 25 that is less than the height of the shroud 13 so that the plate member 22 will be even with or recessed below the shroud edge 53 when the first and second connectors are mated together.

As best seen in FIGS. 8–12, each of the first contacts 30 includes a body which is stamped and formed from sheet material and is configured with the mating portion 32, a retention section 33, and a pad section 34. The retention section 33 is closely held in a cavity in the base portion 12. The pad section 34 is disposed in a recess 56 in the board mounting face 52 of the base portion 12. A solder ball attachment surface of the pad section 34 is even with or below the board mounting face 52, thereby minimizing solder wicking on sides of the pad section 34 during subsequent solder reflow operations. Further, having the solder ball attachment surface of the pad section 34 coplanar with the board mounting face 52 also facilitates silk screening of a solder paste over the mounting face 52 and pad sections 34. The solder ball 50 is attached to the pad section 34 by a suitable deposition process. The mating portion 32 includes a pair of opposed beams 58 in the form of a tuning fork. The beams 58 extend beyond the mating face 14 of the base portion but are below the edge 53 of the shroud, whereby the beams are partially shielded from inadvertent damage. The beams 58 of each contact are aligned in a respective plane, and the planes of all of the contact beams are aligned in parallel, laterally extending planes, as shown in FIGS. 4 and 5.

Each of the second contacts 40 includes a stamped and formed body having a pad section 44 and a blade section 45. Similar to the first contacts 30, the pad section 44 of each second contact is disposed in a recess 46 in the plate member 22 and is joined to a solder ball 48. The blade section 45 is closely held in a cavity in the plate member 22. The blade section 45 also serves as the mating portion 42 of the contact. The blade sections of the second contacts are aligned in parallel, longitudinally extending planes, as shown in FIGS. 6 and 7. A cavity 26 in the plate member 22 intersects the plane of each blade section 45 and extends on opposite sides of the mating portion 42. The cavity 26 can accommodate the beams 58 of the first contact mating portion 32. When the first and second connectors are mated, the blade section 45 is engaged between the beams 58 to electrically connect the first and second contacts. It should be noted that since the blade sections 45 are exposed for mating within the cavities 26, substantially all of the length of each blade section 45 is below the mating face 24, thereby protecting the blade sections from inadvertent damage.

The beams 58 of the first contact and the blade section 45 of the second contact can be adjusted in height to accommodate different size solder balls 48, 50 while maintaining a constant stack height for the connector assembly.

The polarizing and alignment holes 60 in the base portion 12 are through-holes, although it should be noted that connector assemblies with taller stack heights do not need to have the alignment holes as through-holes. Each of the pins 62 of the second connector has a length which is sufficient to extend fully through its respective through-hole 60 when the first and second connectors are mated together. Further, the holes 60 are disposed adjacent to respective surfaces 18 of the shroud. The chamfers 54 and the surfaces 18 cooperate with the pins 62 having chamfers 64 to guide the first and second connectors into mutual alignment for proper mating of their respective contacts. The pins 62 in cooperation with the shroud 13 ensure that alignment of the first and second connectors occurs before any engagement between the first and second contact mating portions 32, 42, thereby preventing contact interference and possible damage. Polarization is achieved because the three holes 60 are disposed in a non-equilateral triangular configuration.

The invention provides an electrical connector assembly having a very low height for interconnecting parallel circuit boards at a small spaced-apart distance. The assembly includes first and second connectors having a shroud and alignment pins which serve to align the connectors prior to mating of contacts in the connectors. The shroud also serves to protect the contacts which are exposed in the first connector.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector assembly for interconnecting a pair of circuit boards in parallel spaced-apart planes, the assembly comprising:

a first connector including a dielectric first housing having a mating face and an array of first contacts exposed along the mating face, the first housing having a shroud defining a boundary around the array of first contacts, the shroud having an edge at a height above the mating face and the first contacts being recessed below the edge; and a second connector including a dielectric second housing having a mating face and an array of second contacts exposed along the mating face for mating with the first contacts, the second housing being configured for complementary reception within the boundary of the shroud, wherein the shroud serves to align the first and second housings for mating before engagement of the first and second contacts can occur.

2. The connector assembly according to claim 1 wherein the second housing is dimensioned for reception within the height of the shroud.

3. The connector assembly according to claim 1 wherein one of the first and second housings has polarizing pins which are receivable in complementary holes in the other of the first and second housings.

4. The connector assembly according to claim 3 wherein the holes are through-holes.

5. The connector assembly according to claim 1 wherein the second housing has alignment pins which are guided by the shroud during mating of the first and second connectors.

6. The connector assembly according to claim 1 wherein the first and second contacts include matable forks and blades.

7. The connector assembly according to claim 1 wherein at least one of the first and second connectors has a board mounting face on an opposite side from the mating face, the contacts of the at least one connector have pad sections exposed along the board mounting face, and solder balls are attached to the pad sections.

8. The connector assembly according to claim 7 wherein the pad sections are recessed below the board mounting face.

9. The connector assembly according to claim 1 wherein at least one of the first and second connectors has its contacts exposed in respective recesses below the mating face of the at least one connector.

* * * * *